United States Patent [19]

Gottlieb et al.

[11] Patent Number: 5,027,279

[45] Date of Patent: Jun. 25, 1991

[54] METHOD AND APPARATUS FOR REMOTELY CONTROLLING A DOCUMENT INSERTER

[75] Inventors: Robert K. Gottlieb, Bridgeport; Elias B. Haidar, Danbury, both of Conn.

[73] Assignee: Pitney Bowes Inc., Stamford, Conn.

[21] Appl. No.: 292,051

[22] Filed: Dec. 30, 1988

[51] Int. Cl.[5] ..... G08B 7/06

[52] U.S. Cl. ..... 364/478; 364/138; 364/188; 364/185; 340/825.06

[58] Field of Search ..... 364/478, 468, 479, 464.02, 364/188, 138, 471, 185; 358/302, 304; 270/58, 56; 209/584, 900; 340/825.06, 825.22, 825.25, 825.12, 825.16

[56] References Cited

U.S. PATENT DOCUMENTS 3,914,538 10/1975 Perreault et al. ..... 358/302

4,547,856 10/1985 Piotroski et al. ..... 364/478

4,797,832 1/1989 Axelrod et al. ..... 364/478

4,837,714 6/1989 Brookner et al. ..... 364/550

4,853,869 8/1989 Durst, Jr. et al. ..... 364/478

*Primary Examiner*—Jerry Smith

*Assistant Examiner*—Paul Gordon

*Attorney, Agent, or Firm*—Charles R. Malandra, Jr.; David E. Pitchenik; Melvin J. Scolnick

[57] ABSTRACT

A document inserter has a touch screen for manually controlling the functioning of the inserter from a central location. The touch screen is capable of providing a plurality of different displays. A remote transmitter communicates with the control system of the inserter to remotely control a limited number of functions of the inserter, and preferably only during the occurrence of one or a limited number of the possible displays. Remote control also causes the emission of an audible warning.

12 Claims, 5 Drawing Sheets

METHOD AND APPARATUS FOR REMOTELY CONTROLLING A DOCUMENT INSERTER

BACKGROUND OF THE INVENTION

This invention relates to document inserters that are employed, for example, for the inserting of documents into envelopes for mailing. The invention is more in particular directed to a method and apparatus enabling remote control of such inserters.

Document inserters, of the type to which the present invention is directed, are disclosed, for example, in U.S. Pat. No. 4,517,650. Model 8300 Inserter, manufactured by Pitney Bowes Inc., of Stamford Conn., are commercially available. Inserters of this type include a number of modules, for example for stacking inserts for insertion in envelopes, and are controlled by a central control system. The control system employs a touch screen for controlling the inserter, the touch screen is capable of displaying a relatively a large number of screen presentations, for example for displaying the machine status and for controlling various set-up and other functions, as well as for controlling starting, stopping and single cycling of the machine. In the past it has been considered necessary that all of these functions be centrally performed at the touch screen.

SUMMARY OF THE INVENTION

In accordance with the present invention, it has been found that advantages are derived by employing a remote control for certain function of an inserter of the above type, at least under predetermined conditions. For example, it may be desirable to be able to remotely control the inserter only when the screen of the touch screen display displays a specific control function, so that remote control is not possible during other operational functioning the inserter.

The invention provides a document inserter having a touch control display screen and a control system for controlling the inserter and the display screen The control system comprises means for enabling a plurality of different displays on the display screen. A portable remote control transmitter is provided for emitting a plurality of control signals, and a receiver is coupled to the control system for receiving the control signals. The control system comprises means for controlling the inserter in response to receipt of the control signals by the receiver, only during a predetermined number, for example, one, of displays on the display screen. The predetermined number is less than all of the plurality of possible display screens.

The inserter may further comprise a device for providing an audible alarm, in which case the control system comprises mean responsive to receipt of a control signal by the signal receiver for energizing the audible alarm device.

The control signal from the remote transmitter may be limited to control signals for starting, stopping and single-cycling the inserter.

The invention also provides a method for remotely controlling an inserter that has a touch screen and a control system for controlling the touch screen to show a plurality of different displays on the touch screen, and wherein the control system controls the operation of the inserter. The method comprises sending a control signal to the control system from remotely of the inserter, and controlling the inserter in response to the control signal only during the occurrence of a predetermined number of the displays. The predetermined number is less than all of the displays.

BRIEF DESCRIPTION OF THE DRAWING

In order that the invention may be more clearly understood, it will no be disclosed in greater detail with reference to the accompanying drawing, wherein.

DETAILED DISCLOSURE OF THE INVENTION

Figure 1:
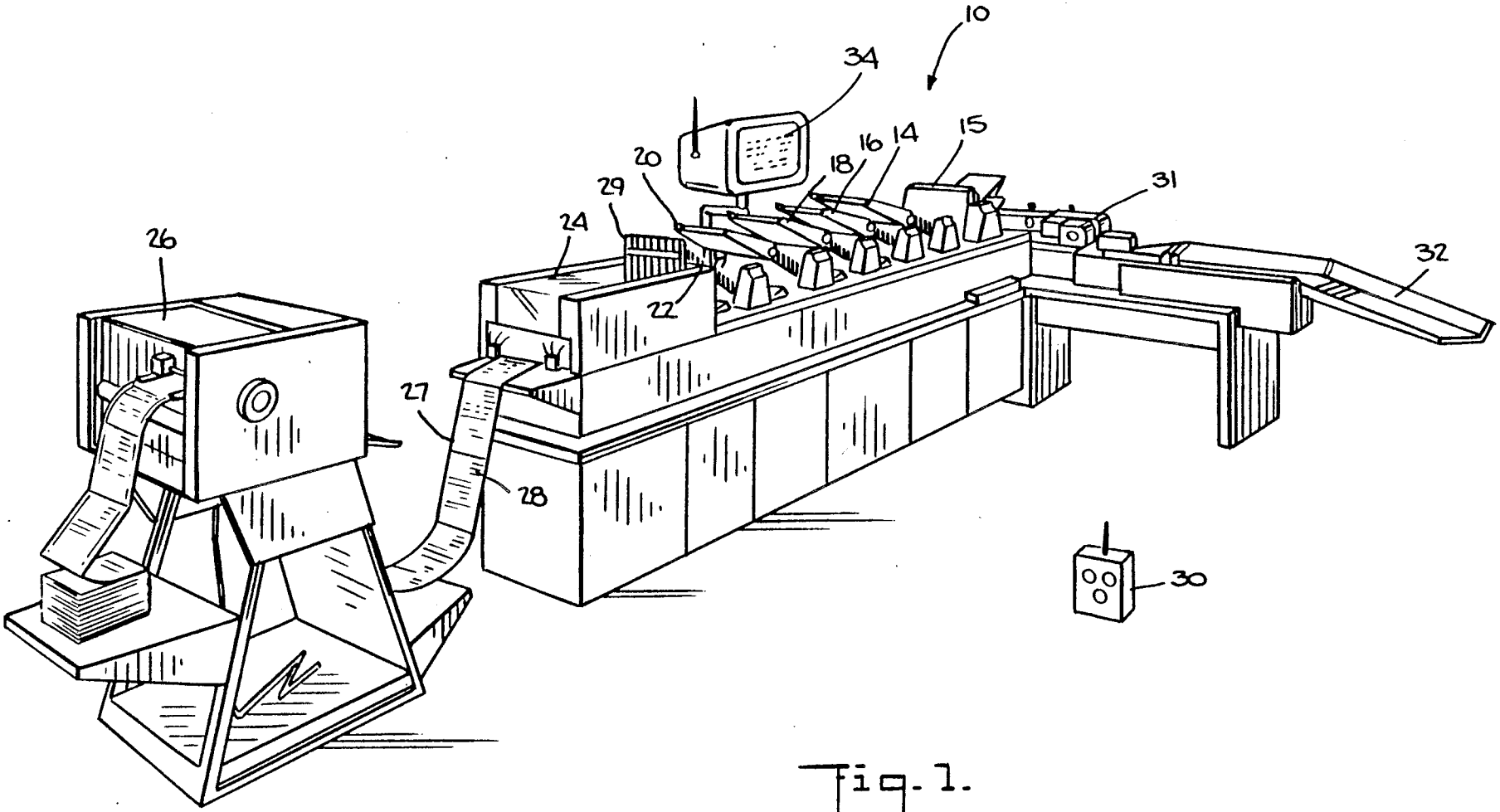
FIG. 1 is a perspective view of a multistation document inserter and including the remote control system in accordance with the invention.

FIG. 1 is a perspective view of a document inserter 10, for example a Pitney Bowes Type 8300 inserter, as disclosed in U.S. Pat. No. 4,517,650, in combination with the present invention. The inserter includes a plurality of serially arranged modules including an envelope feeder station or module 15 and six document feeder stations, including five feeder modules designated as 14, 16, 18, 209 and 22 and burster-folder station or module 24. A computer generated forms feeder 26 feeds continuous form control documents 27 having coded marks 28 thereon to the burster-folder 24 for separating and folding. The coded marks 28 on the control documents 27 are sensed by a control scanner 29. Thereafter the serially arranged feeder stations 22, 20, 18, 16 and 14 sequentially feed the necessary documents onto the transport deck 30 at each station as the control document 27 arrives at the respective station, to form a precisely collated stack of documents which is to be transferred to the envelope feeder 15.

The collated stack of documents is inserted in an envelope at the envelope station 15. The necessary postage is provided and the envelope is sealed by a meter 31. As desired, the completed envelopes may then be transported to a single or multi-station level stacker 32.

The inserter 10 also includes a central control display 34 which displays status messages and fault signals in human readable form, and further enables the operator to control and change the configuration of the inserter 10 by finger touch switches. Further details of the construction and operation of the inserter 10 which are not necessary are disclosed in U.S. Pat. No. 4,517,650, the disclosure of which is encorporated herein by reference.

As further illustrated in FIG. 1, the system in accordance with the invention includes a hand held remote transmitter 30, adapted to communicate with the control arrangement of the central control display 34.

Advantageously, the central control display 12 is a finger touch display, such as Fluke Model 1780A InfoTouch Display. The central control display 12 may be of the type disclosed in patent application Serial No. 394,388 filed on July 1, 1982 in the names of Peter N. Piotroski and John M. Gomes, entitled UNIVERSAL MULTI- STATION DOCUMENT the disclosure of which is incorporated herein by reference. As disclosed in the aforementioned patent application, the central control display 32 is electrically connected to a supervisory control circuit of the multi-station document inserter 10 through a RS232C standard communication line. The central control display 34 provides an operator or user with certain switches which when activated cause the inserter 10 to undergo certain routines and provide displays in human readable form.

Figure 2:
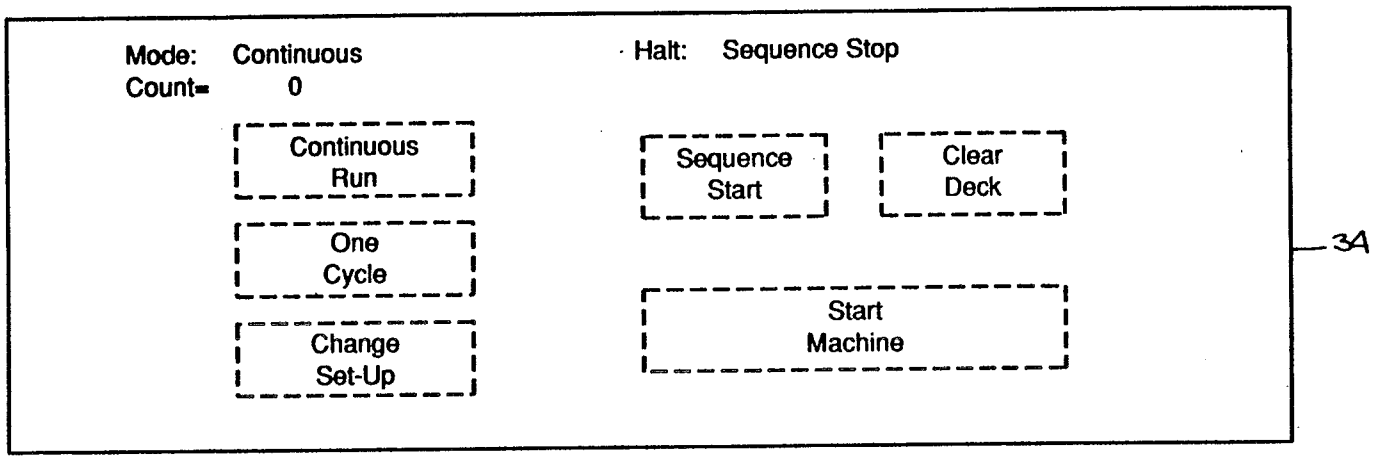
FIG. 2 is an illustration of the display present on the central control display of the system of FIG. 1.

As illustrated in FIG. 2, the central control display 34 is shown with certain information displayed that is displayed upon Power Up. Specifically, the following touch switches are displayed:

Start Machine—For starting the machine operation.

One Cycle—For activating the machine for one cycle of operation.

Continuous Run—For activating the machine for continuous-run operation.

Sequence Start—For sequentially activating one feeder module per cycle. This switch activates the envelope module feeder in time to insert the first collation.

Stop—For stopping the operation of the inserter. Actual cessation of operation can normally occur at only one point in the inserter cycle.

Clear Deck (Sequence Stop)—This switch sequentially deactivates one feeder module per cycle. It also deactivates the envelope feeder after the last collation is inserted, and processes the last inserted collation through postage meter (if applicable) to the stacker.

Change Set-Up—This switch switches to a different display, for example for providing a display of the inserter configuration to enable a change in the inserter operation.

The display screen may also display information enabling the operator to determine:

Operating Mode
Fault Condition (if any)
Piece Count
A maintenance reminder message showing the first power-up after one million cycles. This reminder message may be displayed after each subsequent power-up until canceled by a service technician.

Figure 3:
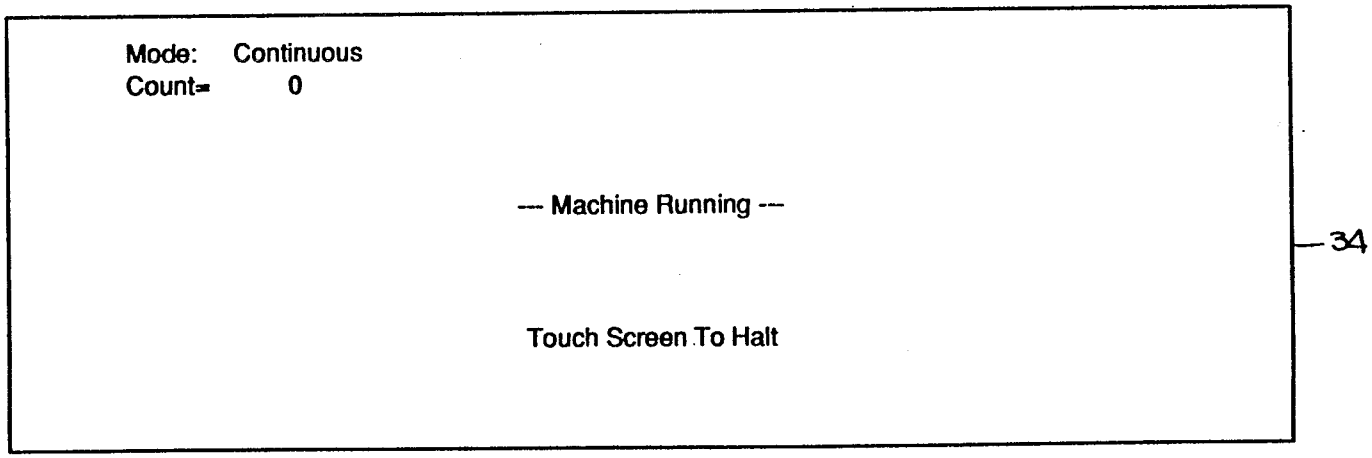
FIG. 3 is an illustration of the display on the central control display of the system of FIG. 1 during a continuous run operation.

FIG. 3, illustrates a further typical screen, that may be displayed during continuous run operation. It shows the following information:

Operating Mode
Piece Count
Action To Be Taken To Halt Operation

Figure 4:
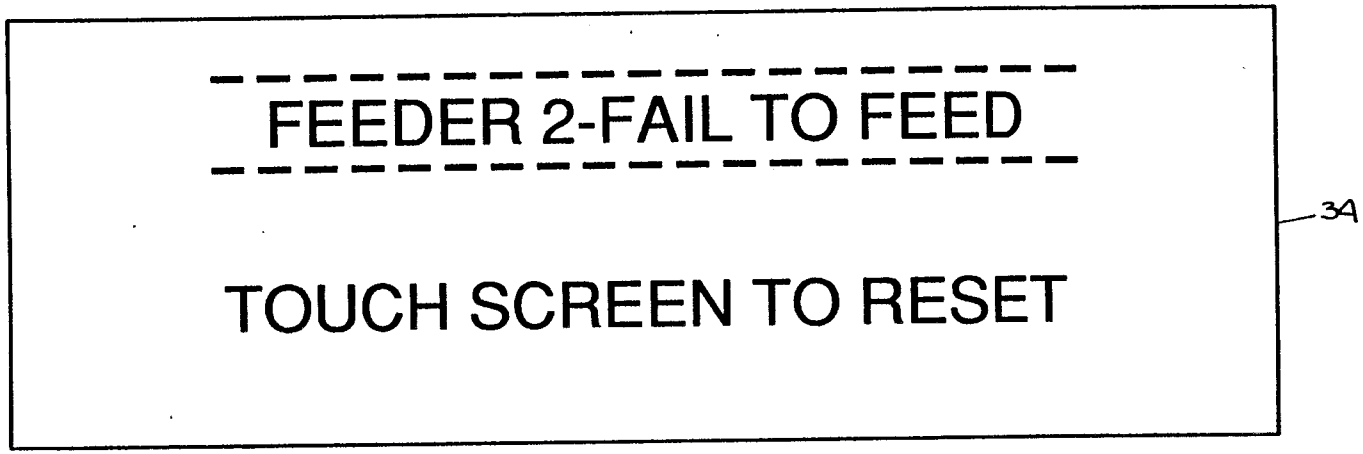
FIG. 4 is an illustration of the display on the central control display of the system of FIG. 1 when a fault condition is detected.

FIG. 4, shows a further screen, that may be displayed upon detection of a fault by the supervisory control circuit of the document inserter 10. This screen displays the fact that a fault has occurred, and the location of the fault.

Figure 5:
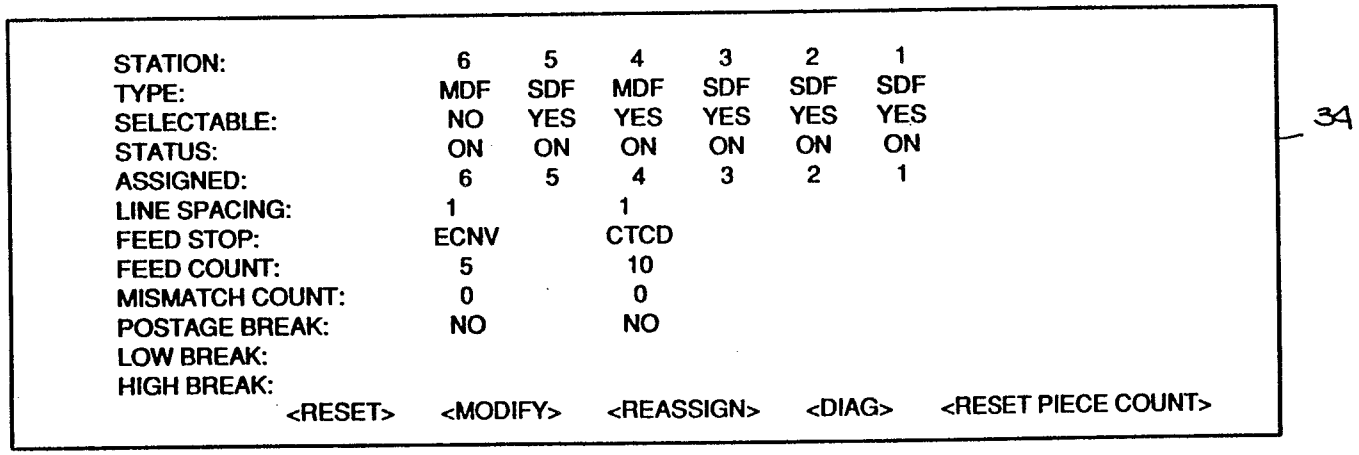
FIG. 5 is an illustration of the display on the central control display of FIG. 1 when the inserter configuration is displayed.

FIG. 5 shows a display that may be present when the operator actuates the inserter Change Set Up switch discussed with reference to FIG. 2. This screen shows the following information regarding the configuration of the inserter:

Station Numbers
Type of Feeder per Station Number
Feeder Select Status
Feeder On/Off Status
Assigned Station Number
Line Spacing (scan marks at multiple document feeders)
Feed Stop
Feed Count
Mismatch Count
Postage Break
Low Break
High Break Additionally, Reset, Modify, Reassign, Diagnosis and Reset Piece Count switches may displayed.

It is of course apparent that the above discussed displays are only a small number of examples of screens that are employed in typical touch screen inserter displays.

Figure 6:
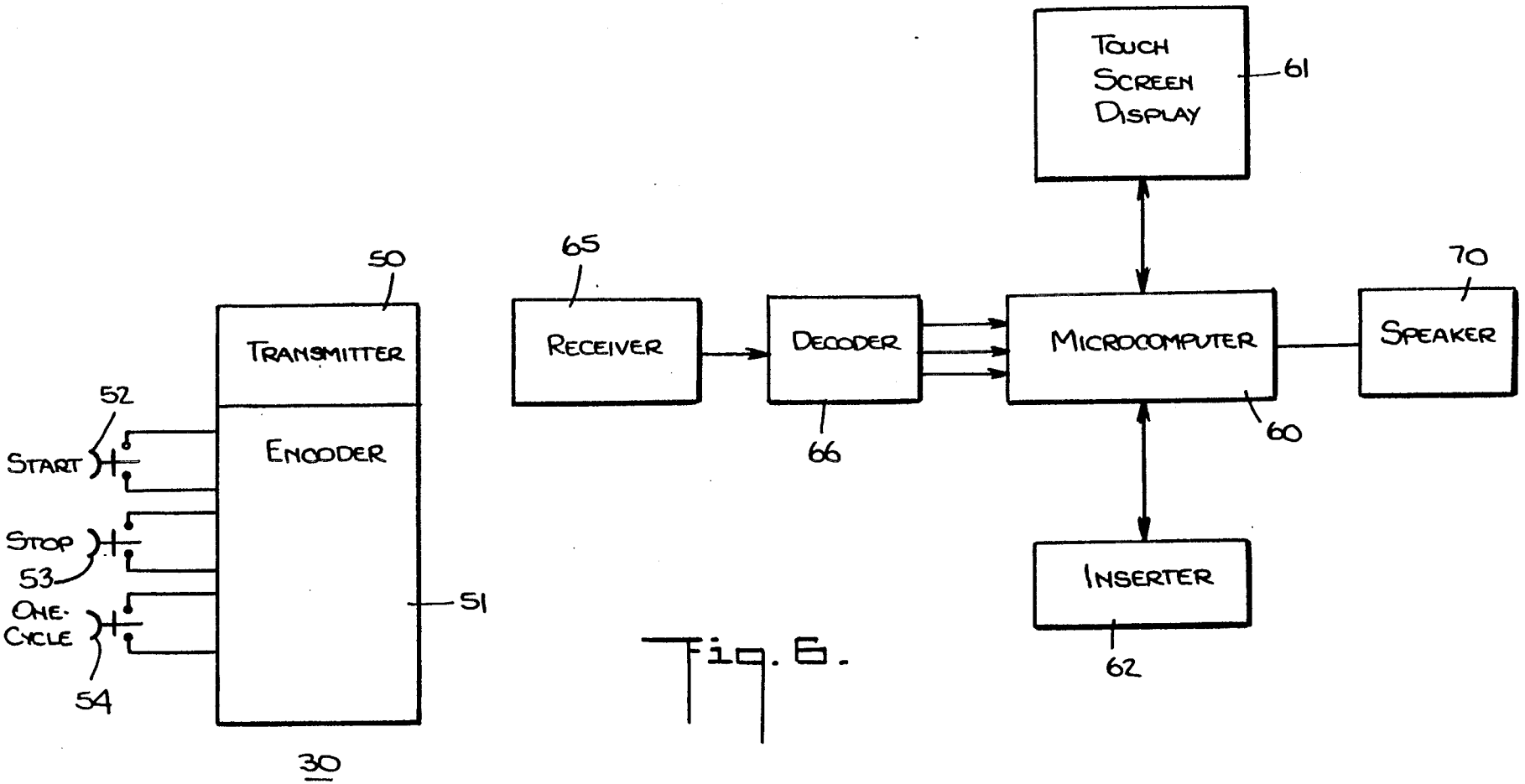
FIG. 6 is a block diagram of a control system in accordance with the invention.
Figure 7:
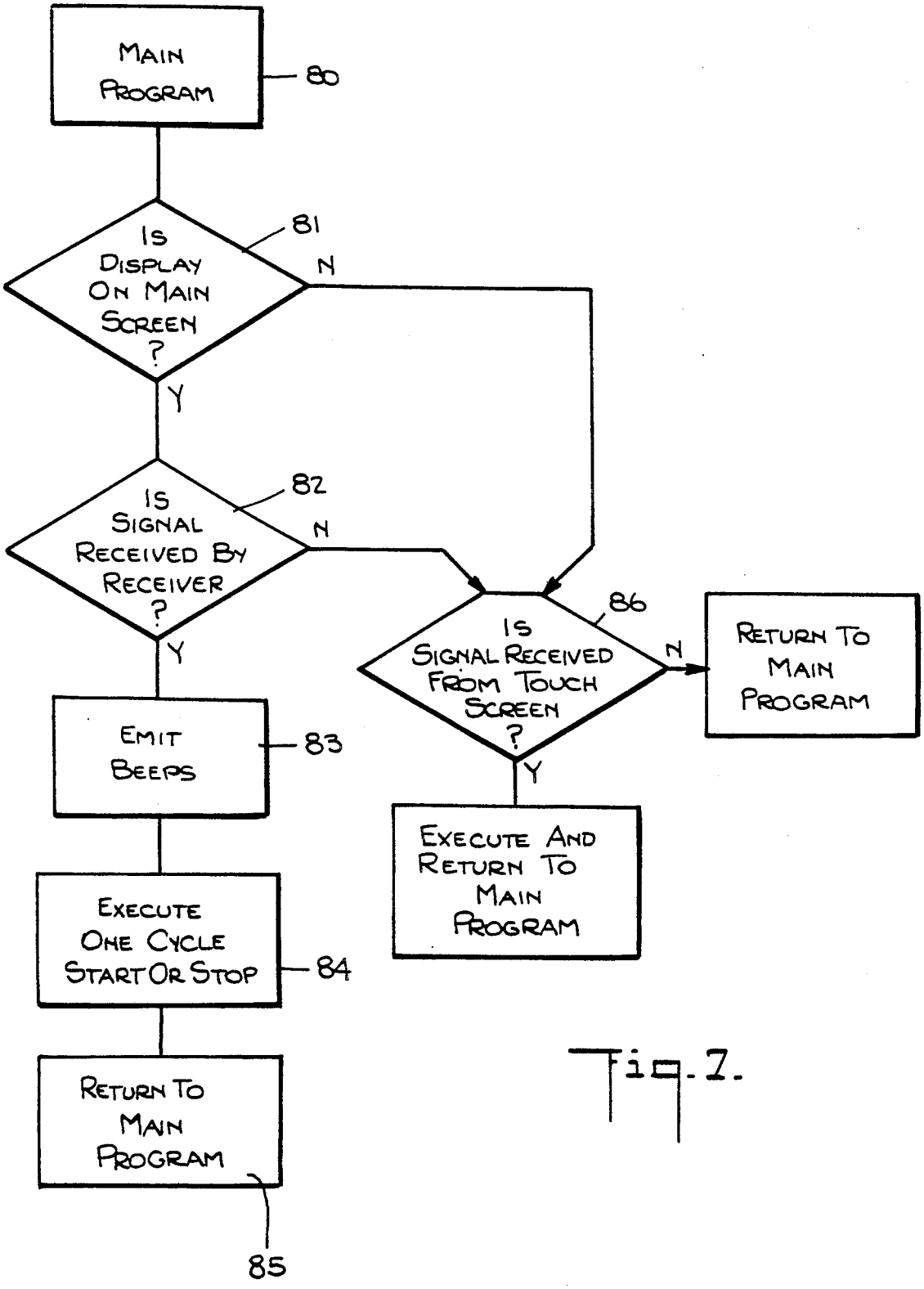
FIG. 7 is a flow diagram illustrating the operation of the system of the invention.

As illustrated in FIG. 6, the hand held transmitter 30 in accordance with the invention may be comprised of a signal transmitter 50 for transmitting radio oscillations modulated by an encoder 51. The encoding of the encoder is controlled by manually operated switches, such as the START switch, the STOP switch 53 and the ONE-CYCLE switch 54, so that the signals transmitted by the transmitter 50 are uniquely dependent upon the activation of the switches 52–54. This device may be comprised, for example of an RCS4-1 command system as manufactured by Remtron, Inc. of Oceanside, Calif., 92054. It is of course apparent that other devices may alternatively be employed, similar for example to a conventional garage door opener, and that other remote control arrangements, such as but not limited to, ultrasound, may alternatively be employed.

Still referring to FIG. 6, the central control system of the inserter comprises a microcomputer 60 coupled to the touch display screen 61 and the inserter 62, for control in the above described manner. A signal receiver 65, such as a radio receiver, is provided on the inserter, for receiving signals from the transmitter. The receiver may, for example, be located in the display 34 as illustrated in FIG. 1. The receiver and decoder may be comprised of components of the above discussed RCS4-1 command system. The output of the receiver is applied to a decoder 66 for producing outputs selectively dependent upon the depression of the switches 52–54, and this data is output to the microcomputer 60. Accordingly, the microcomputer 60 for controlling the inserter 62 is provided with data corresponding to which, if any, of the switches 52–54 has been depressed.

In addition, in accordance with a further feature of the invention, the microcomputer also controls a speaker 70 or other device for producing an audible output.

The remote control transmitter 30 thereby enables an operator or service personnel to control the operation of the inserter, in a limited number of modes, from locations other than at the touch screen itself. This capability has been found to greatly facilitate the setup and servicing of the inserter, since many locations of an inserter of the above type that must be observed during certain operations are too far from the touch screen to permit a single person to both control the machine and observe its operation.

It has further been found that such remote control is advantageously permissible only during the display of certain display screens on the display, for example, only during the occurrence of the display illustrated in FIG. 1. This feature prevents danger to personnel as well as to the inserter, ensures that the signals from the transmitter are processed properly for the desired control of the inserter.

In accordance with a still further feature of the invention, the microcomputer 60 controls the speaker 70, upon receipt of a valid control signal from the decoder 66, to emit a distinctive audible signal, such a three beeps, so that other personnel a warned that the inserter is being operated even though no controller is present at the touch screen itself.

FIG. 17 illustrates a flow diagram of the operation of the program of the microcomputer 60, in accordance with one embodiment of the invention. As illustrated, the program branches from a main program 81, and during the occurrence of the main screen (e.g. of FIG. 2), determines at block 82 if a valid control signal has been received from the signal receiver. If a valid signal has been received, an audible signal is emitted, at block 83, the desired function is executed, at block 84, and the subroutine returns to the main program, at block 85. If a control signal was received, instead, from the touch screen, as indicated at block 86, the desired control is executed and control is returned to the main program.

In other words, the remote control transmitter is effective to control the inserter only during the occurrence of the main screen, and during the display of the main screen only a limited number of predetermined functions may be controlled by the remote transmitter. In the preferred embodiment of the invention, this control functions are only the starting, stopping and one-cycling of the inserter. In addition, contrary to operation under control of the touch screen itself, commands executed under control of the remote transmitter result,, in the production of an audible warning. The remote transmitter may be conveniently carried by service personnel, for example on their belts.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. In a document inserter having a touch control display screen and a control system for controlling said inserter and said display screen, and wherein said control system comprises means for enabling a plurality of different displays on said display screen, the improvement comprising a portable remote control transmitter for emitting a plurality of control signals, a receiver coupled to said control system for receiving said control signals, and a device for providing an audible alarm, said control system comprising means for controlling said inserter in response to receipt of said control signals by said receiver, only during a predetermined number of displays on said display screen, and said control system comprising means responsive to receipt of a control signal by said signal receiver for energizing said audible alarm device.

2. The inserter of claim 1 wherein said predetermined number is one.

3. The inserter of claim 1 wherein said control signals comprises a control signal for starting said inserter, and said control system comprises means responsive to receipt of said control signal for starting said inserter.

4. The inserter of claim 1 wherein said control signals comprises a control signal for stopping said inserter, and said control system comprises means responsive to receipt of said control signal for stopping said inserter.

5. The inserter of claim 1 wherein said control signals comprises a control signal for single-cycling said inserter, and said control system comprises means responsive to receipt of said control signal for single-cycling said inserter.

6. The inserter of claim 1 wherein said control signals consist only of first, second and third signals, and said control system comprises means responsive to receipt of said first, second and third signals for stopping, starting and single-cycling said inserter.

7. The inserter of claim 1 wherein said predetermined number is less than all of said plurality of display screens.

8. The inserter of claim 1 wherein said portable remote control transmitter is a hand held transmitter whereby an operator can control the operation of the inserter from a location remote from the display screen.

9. A method for remotely controlling an inserter that has a touch screen and a control system for controlling said touch screen to show a plurality of different displays on said touch screen, said control system controlling the operation of said inserter, said method comprising sending a control signal to said control system from remotely of said inserter, controlling said inserter in response to said control signal only during the occurrence of a predetermined number of said displays, and emitting an audible signal in response to said control signal, during the display of said predetermined displays.

10. The method of claim 9 wherein said step of controlling comprises controlling said inserter in response to said control signal only during the occurrence of a single one of said displays.

11. The method of claim 9 wherein said step of controlling in response to said control signal consists only of controlling said inserter to start, stop and single-cycle.

12. The method of claim 9 wherein said predetermined number is less than all of said displays.

* * * * *